United States Patent [19]

Barriac

[11] Patent Number: 4,664,278

[45] Date of Patent: May 12, 1987

[54] TAMPER INDICATING PACKAGE

[75] Inventor: Jacques J. Barriac, Toledo, Ohio

[73] Assignee: Owens-Illinois, Inc., Toledo, Ohio

[21] Appl. No.: 878,108

[22] Filed: Jun. 25, 1986

[51] Int. Cl.[4] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 3,455,478 | 7/1969 | Fields et al. | 215/252 |
| 3,463,341 | 8/1969 | Fields | 215/252 |
| 3,944,102 | 3/1976 | Grau | 215/258 X |
| 4,352,436 | 10/1982 | Chartier | 215/252 |
| 4,461,391 | 7/1984 | Davis | 215/252 |
| 4,505,401 | 3/1985 | Berglund | 215/252 |
| 4,529,096 | 7/1985 | Chartier et al. | 215/252 |

*Primary Examiner*—Donald F. Norton

*Attorney, Agent, or Firm*—John R. Nelson

[57] ABSTRACT

A tamper indicating package including a container having a neck with an external thread and an annular retaining bead below the thread and a plastic closure comprising a base wall, a peripheral skirt and a tamper indicating band connected to the free edge of the peripheral skirt by integral bridges. The tamper indicating band includes an integral portion that extend below the annular bead on the container such that when the closure is unthreaded, the bridges are broken. The band includes integral circumferentially spaced supports that extend axially toward the free edge of the peripheral skirt and the bridges extend from the supports to the free edge. Each bridge includes a generally axial leading edge and a generally axial trailing edge. The upper edge of leading edge in the direction of unthreading intersects the lower edge of the skirt at a sharp corner to define a stress concentration point at the edge of the skirt. The lower edge of the leading edge of each bridge intersects the band along a radius. The trailing edge intersects the lower edge of the skirt and the upper edge of the band along radii. As a result when the closure is rotated to unthread it from the container, the bridges break at the stress concentration points at the edge of the skirt of the closure.

18 Claims, 9 Drawing Figures

TAMPER INDICATING PACKAGE

This invention relates to tamper indicating packages and closures utilized therein.

BACKGROUND AND SUMMARY OF THE INVENTION

In packaging of containers having closures thereon, it has been common to provide tamper indicating packages wherein the tamper indicating band is connected to the closure along the weakened line provided by a plurality of bridges and interengaging means between the band and the container are such that when the closure is unthreaded from the container, the band is severed along the bridge portions to indicate that the closure has been tampered with.

It has thus been recognized that a major problem with respect to such tamper indicating packages is that the bridges must be strong enough to withstand the forces of applying the closure to the container and yet be weak enough so that they do not require excessive force by the user in removing the closure from the container.

In one type of closure, the interengaging means between the band and the container comprises an annular bead on the inner surface of the band and a retaining bead on the finish of the container. Typical constructions of this type are shown in U.S. Pat. Nos. 3,329,295, 3,455,478, 3,784,041, 4,343,408, 4,352,436 and 4,461,390.

One of the major problems with respect to closures that use a continuous annular bead is that when the closure is applied to the container, a relatively high application torque is transmitted to the frangible bridges resulting in premature breakage. Generally attempts to resolve this problem include increasing the strength of the bridges. This creates a new problem during removal because the frangible bridges are then too strong and will not readily break. To resolve this problem, interference between the annular bead on the band and the retaining bead on the container can be changed but this leads back to the first problem, namely, that the frangible bridges will break during application. As a result, it is necessary in this type of closure to carefully control the tolerances of the internal diameter of the bead of the band and the outer diameter of the bead on the container. However, in the case of a glass container, such close tolerances cannot be readily maintained in accordance with normal glass manufacturing techniques and costly manufacture is required.

It has heretofore been suggested that projections be provided at circumferentially spaced points between the bridges to limit the degree of compression of the bridges during application of the closure to the container. Typical patents showing such an arrangement are U.S. Pat. Nos. 3,463,341, 4,352,436 and 4,461,390. However, this has not eliminated the problem since it is still very difficult to control the tolerances when the closure is being used particularly in connection with glass containers.

Other suggestions are shown, for example, in U.S. Pat. No. 3,455,478 which shows a tamper indicating closure wherein the bridges are inclined at an acute angle and extend rearwardly in a direction opposite to which the closure is rotated in order to place the bridges under compression and provide a greater resistance to rupture. The bridges are attached to the skirt and band and the bridges form acute angles with a recess in the skirt. As a result, one portion of the bridge is under compression while the other is under tension resulting in premature breakage.

In U.S. Pat. No. 3,463,341, the bridges are tapered toward the peripheral skirt and, in one form, inclined forwardly in the direction in which the closure is rotated As a result they are susceptible to premature breakage during application of the closure.

In U.S. Pat. No. 3,944,102, the bridges extend from abutments on the skirt and band so that the amount of compression during application of the closure is limited. The bridges stretch by vertical stretching during removal of the closure. The problem with such an arrangement is that the bridges do not provide any resistance against crushing during either the demolding or capping operation.

In U.S. Pat. No. 4,352,436, in addition to abutments or projections extending from the skirt of the closure toward the band, the bridges are inclined forwardly or in the direction in which the closure is rotated to remove the closure. It is contemplated that by this arrangement when the closure is applied, the bridges are stressed to limit the relative rotation of the closure and the band.

U.S. Pat. No. 4,461,391 shows projections on the skirt and band which have ratchet teeth which interengage to resist movement of the band when the closure is unscrewed.

U.S. Pat. No. 4,529,096 shows bridges that are inclined rearwardly with respect to the direction of rotation of the closure during removal from the container and, in addition, projections on the skirt which extend into recesses on the band to limit relative movement of the closure and band during application.

The aforementioned patents are directed to a premature breakage of frangible bridges during the capping operation and set forth features which are necessary when the tamper indicating structure relies on stretching of a solid annular bead of the tamper indicting band or ring over a retaining bead located on the container finish. As indicated earlier such arrangements require a relatively high application torque which is partially transmitted to the frangible bridges resulting in premature breakage. Attempts to resolve this problem by increasing the strength of these bridges creates a new problem during removal of the closure where the frangible bridges are then too strong and do not break. To resolve this problem, the interference between the tamper indicating band and the finish bead can be increased but this leads back to the initial problem namely frangible breakage during application. As a result, it is necessary in utilizing such constructions that the internal diameter of the tamper indicating band bead and the outer diameter of the finish bead must be controlled within close tolerances. This is extremely difficult particularly where the container is made of glass and the closure of plastic and such tolerances cannot readily be obtained at normal production speeds.

Where the tamper indicating band utilizes the flexing of a thin membrane of plastic about a hinge as, for example, in U.S. Pat. No. 4,550,844 and U.S. application Ser. No. 623,659 filed June 22, 1984, having a common assignee with the present application, the torque required to drive these wings or flexible band over the finished retaining bead is very low and as a result, there is no need for additional features to prevent premature bridge breakage during the capping operation.

Among the objectives of the present invention are to provide a tamper indicating package and closure preferably of the type shown in U.S. Pat. No. 4,550,840 and U.S. application Ser. No. 623,659 wherein frangible bridge construction is improved, permitting a larger axial opening or window between the bottom of the peripheral skirt of the closure and the top of the tamper indicating band so that the tamper indicating feature can be more readily viewed and ascertained; wherein the length of the frangible bridge is minimized; wherein the stretching of the frangible bridge is minimized; which forces the rupture or breakage of the frangible bridge at the base or free edge of the skirt of the closure providing a neat and more aesthetic appearance; which supports and protects the frangible bridges during demolding; which frangible bridge construction includes a stress concentrator at one corner of attachment to the bridge which will readily break upon removal of the closure or tampering with the closure.

In accordance with the invention, a tamper indicating package including a container having a neck with an external thread and an annular retaining bead below the thread and a plastic closure comprising a base wall, a peripheral skirt and a tamper indicating band connected to the free edge of the peripheral skirt by integral bridges. The tamper indicating band includes integral portions that extend below the annular bead on the container such that when the closure is unthreaded, the bridges are broken. The band includes circumferentially spaced supports that extend axially toward the free edge of the peripheral skirt and the bridges extend from the supports to the free edge. Each bridge includes a generally axial leading edge and a generally axial trailing edge. The upper edge of leading edge in the direction of unthreading intersects the lower edge of the skirt at a sharp corner to define a stress concentration point at the edge of the skirt. The lower edge of the leading edge of each bridge intersects and the band along a radius. The trailing edge intersects and the lower edge of the skirt and the upper edge of the band along radii. As a result when the closure is rotated to unthread it from the container, the bridges break at the stress concentration points at the edge of the skirt of the closure.

DESCRIPTION

Figure 1:
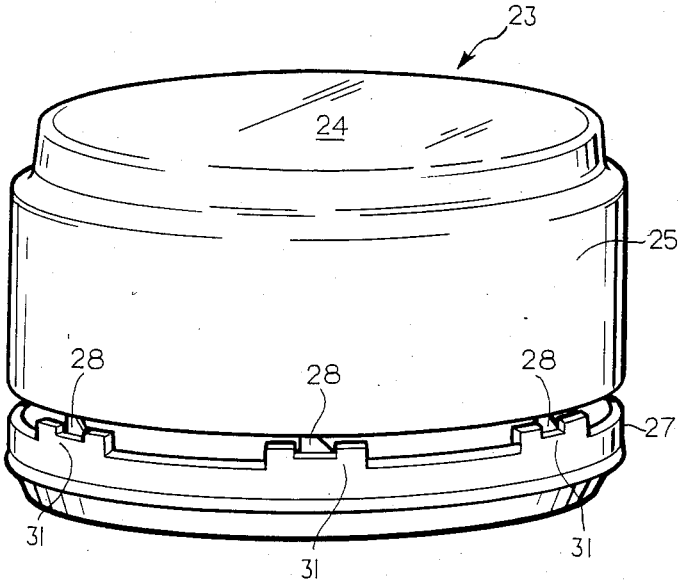
FIG. 1 is a perspective view of a closure embodying the invention.
Figure 2:
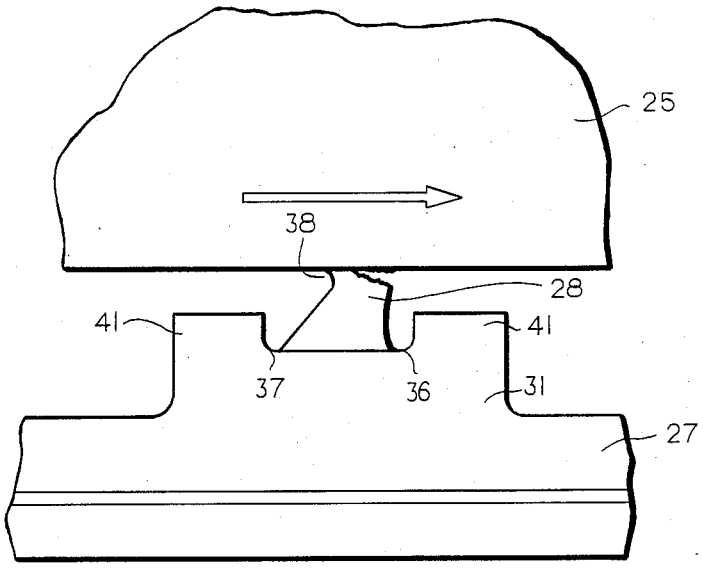
FIG. 2 is a fragmentary partly diagrammatic side elevational view on an enlarged scale of a portion of the closure during removal from the container.
Figure 4:
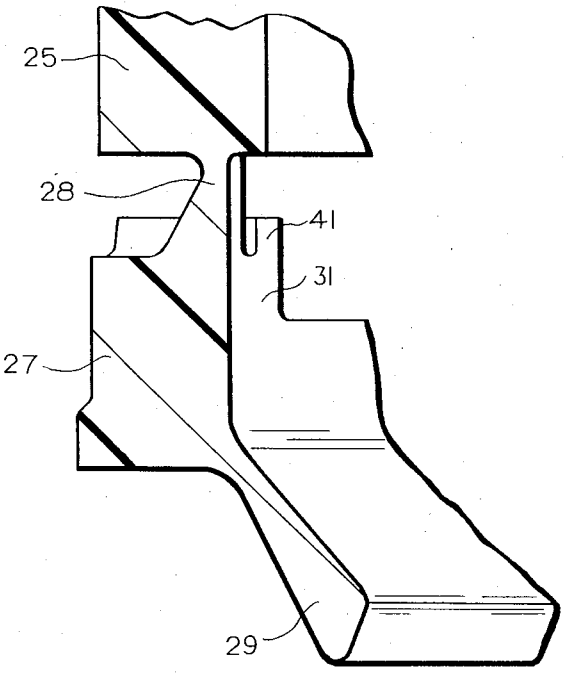
FIG. 4 is a fragmentary side elevational view taken along the line 4—4 in FIG. 3.
Figure 3:
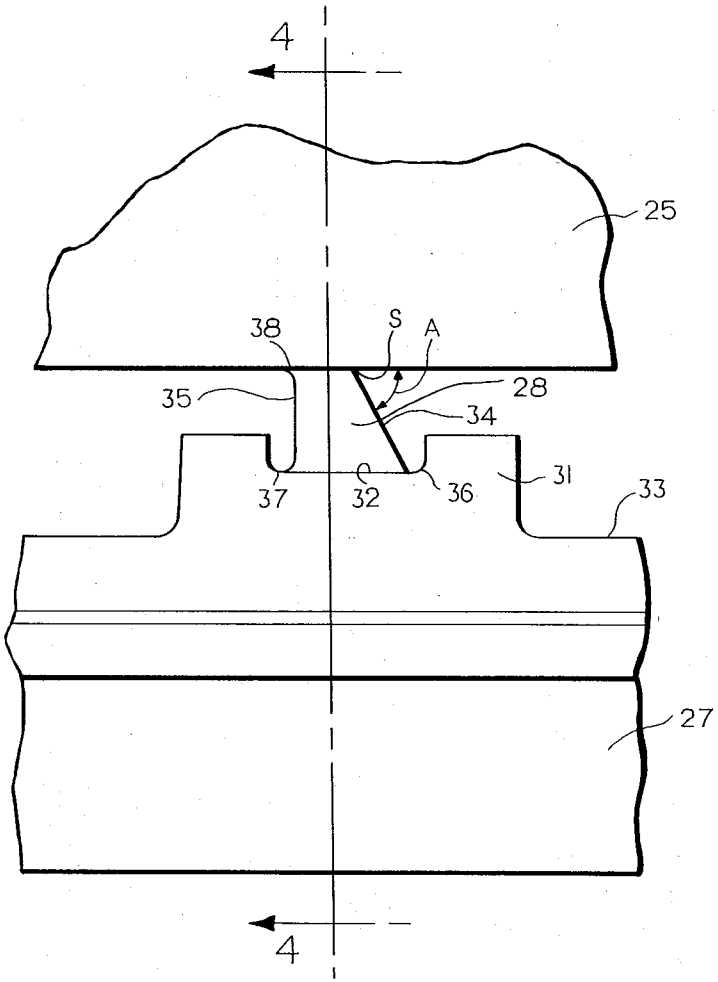
FIG. 3 is a fragmentary side elevational view showing the closure.
Figure 5:
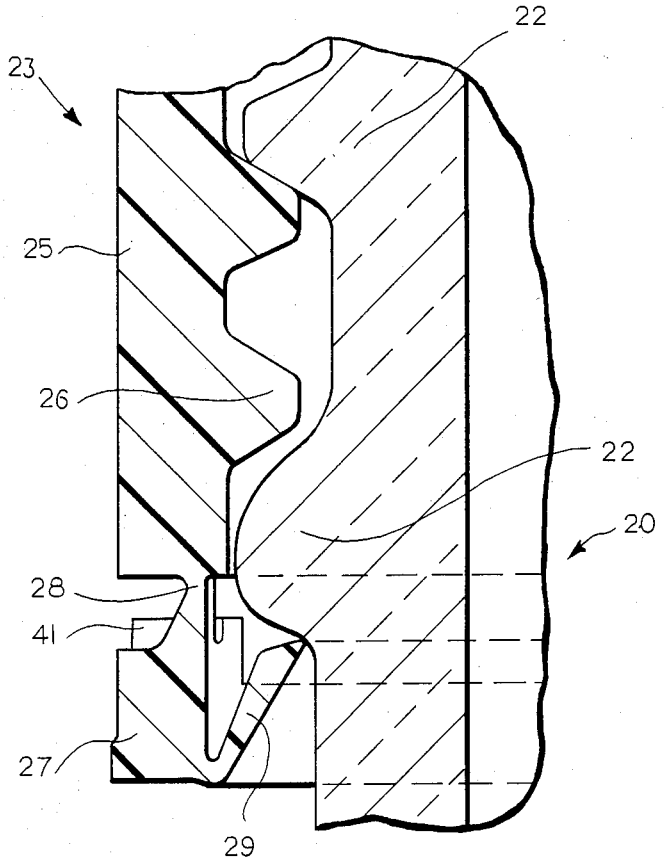
FIG. 5 is a fragmentary sectional view showing the closure on the container.
Figure 6:
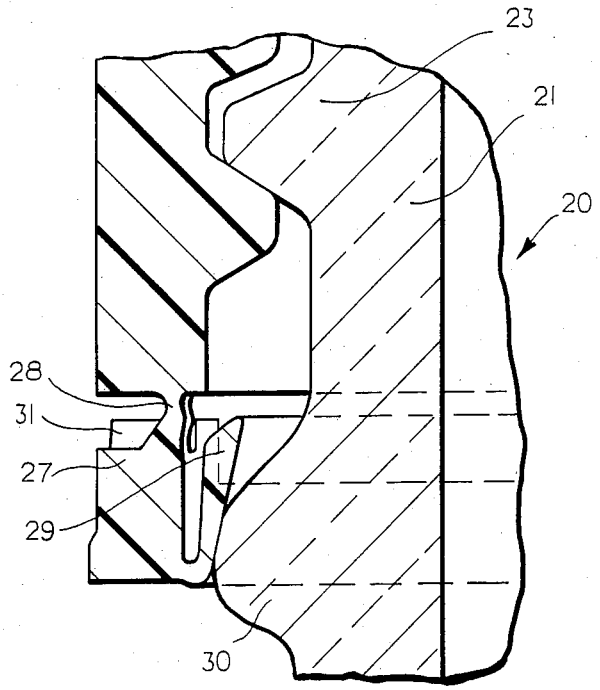
FIG. 6 is a fragmentary sectional view similar to FIGS. 4 and 5 showing the closure during application to the container.
Figure 7:
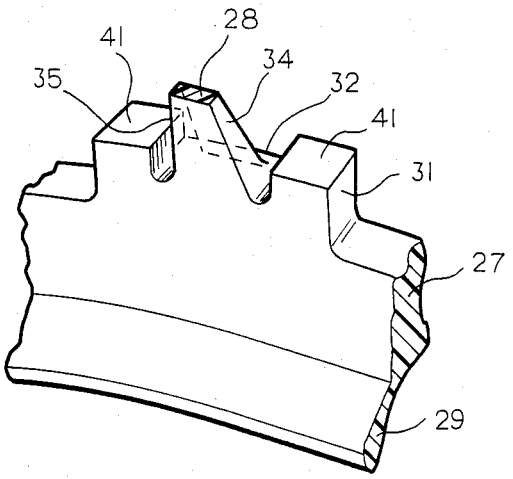
FIG. 7 is a fragmentary perspective view of a portion of the closure shown in FIGS. 1–6.

Referring to FIGS. 1–7 and, the package comprises a container 20 having a finish or neck 21 having external threads 22. A closure 23 is formed of a thermoplastic material molded as a single unit and comprises a generally disc-shaped base wall 24 with a cylindrical depending skirt 25 having internal threads 26 for engaging threads 22 on the container 20. A tamper indicating band 27 is joined to the lower end of the cylindrical skirt by a plurality of frangible bridges 28 (FIG. 2). The band 27 includes an annular integral portion 29 that extends downwardly and outwardly when the closure is molded after which the flange 29 is folded inwardly to derine a flexible flange that extends upwardly and inwardly from said band so that upon application to the container, the flange 29 flexes and extends below an annular retaining bead 30 on the neck 21 of the container. The above described flange is more fully described in the aforementioned patent application Ser. No. 623,659, which is incorporated herein by reference.

In accordance with the invention, the band 27 is attached to the peripheral skirt 25 by a plurality of the circumferentially spaced bridges 28. A plurality of circumferentially spaced integral supports 31 extend axially from the band 27. Each support 31 is provided with a recess 32 such that the recess 32 is raised above the level of the top edge 33 of the band 27. Each integral frangible bridge 28 extends from a recess 32 to the skirt 25 of the closure 23. Each bridge 28 is assymetrical and includes the inclined leading edge 34 and a vertical trailing edge 35. The inclined edge 34 extends upwardly and rearwardly with respect to the direction of rotation of the closure during unthreading and forms an acute angle A with the lower edge of the skirt 25 and the edge 34 intersects the lower edge of the skirt 25 at a sharp corner. The lower edge of the inclined edge 34 is connected to the recess 33 by a curved or radiused portion 36. The lower edge of the vertical edge 35 of each bridge 28 is connected by a curved or radiused portion 37 to the recess and the upper edge of vertical edge 35 is connected to the lower edge of the skirt 25 by a curved portion 33. As viewed in FIG. 4, each bridge 28 is thinner than support 31 in a radial direction and has tapered inner and outer surfaces 39, 40 so that the bridge is thicker adjacent the support 31 than adjacent the skirt 25. This insures that the bridge 28 will break or tear adjacent the skirt 25 leaving a clean lower edge on the skirt 25.

Each support 31 extend axially and includes portions 41 which engage the skirt 25 and provide protection for the frangible bridge 28 preventing total collapse during the demolding or stripping operation of the hot closure at a time when the frangible bridge can be readily damaged. Inasmuch as the forces on application are absorbed by flexing of the flange 29, the engagement of portions 41 with skirt 25 is not required to protect the bridges.

By provision of each frangible bridge 28 as a part of the support 30, a large opening is provided clearly separating the body of the closure from the tamper indicating band 28 and at the same time minimizing the height of the frangible bridges 28. By minimizing the overall height of each frangible bridge 28, the amount of stretching of the bridge 28 is minimized during the first removal of the closure thereby providing an earlier and easier rupture or breakage of the bridges.

The shape of the frangible bridge 28 provides a stress concentration point S at the sharp corner at the apex of the angle A. As shown in FIG. 2, during removal, the stress concentration S will cause the bridge to initiate, a crack will be initiated at the apex of the angle A preventing stretching of each bridge 28 and providing a clear break at the lower edge of the closure skirt 25. This minimized the possibility of ragged edges or spikes which occur when the bridge tends to stretch before breaking. On the other hand, the stress concentration and premature rupture of the bridges will not occur during closure application because the angel A will close. The radii 36, 37, 38 at the other corner will cause stretching without breaking. The radii reduces the stress greatly any tendency to break due to during application of the closure due.

Figure 8:
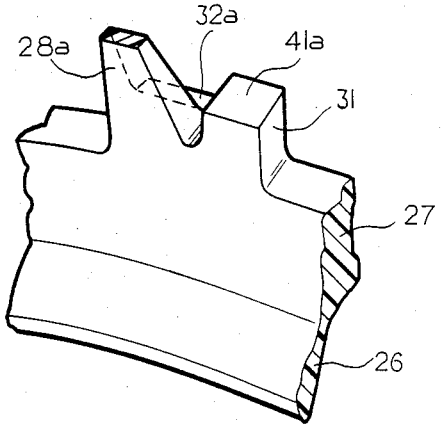
FIG. 8 is a view similar to FIG. 7 of a modified form of closure.
Figure 9:
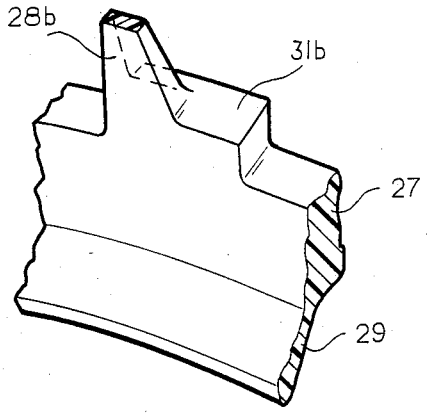
FIG. 9 is a view similar to FIGS. 7 and 8 of a further modified form of closure.

In the modified form of closure and package shown in FIG. 8, the support 31*a* is shaped such that the recess 32*a* is positioned rearwardly with respect to the direction of unthreading of the closure so that the bridge 28*a* is positioned rearwardly and extends from the recess 32 toward the skirt.

In the form shown in FIG. 8, the support 31*b* does not have a recess and the bridge 28*b* extends from the support 31*b* toward the skirt.

It can thus be seen that there has been provided a tamper indicating package enclosure of improved frangible bridge construction, which permits a larger axial opening or window between the bottom of the peripheral skirt of the closure and the top of the tamper indicating band so that the tamper indicating feature can be more readily viewed and ascertained, wherein the length of the frangible bridge is minimized, wherein the stretching of the fragible bridge is minimized, wherein the forces cause breakage of the fragible bridge at the base or free edge of the skirt of the closure providing a neat and more aesthetic appearence, wherein the frangible bridges are protected during demolding and wherein the frangible bridge includes a single stress concentrator point at one corner of attachment which will readily break upon removal of the closure or tampering with the closure.

What I claim is:

1. A tamper indicating package including a container having a neck with an external thread, retaining bead below the thread, a plastic closure comprising a base wall, a peripheral skirt and a tamper indicating band connected to the free edge of the peripheral skirt by integral bridges, said tamper indicating band including portions that extend below the annular bead on the container such that when the closure is unthreaded, the bridges are broken, said band including circumferentially spaced supports that extend axially toward the free edge of the peripheral skirt, said bridges extending from the supports to the free edge of said skirt, each bridge having a first generally axial leading edge and second generally axial trailing edge, said first edge being inclined circumferentially in a direction opposite to that which the closure is rotated during unthreading from the container, the upper edge of the leading edge of each bridge intersecting the lower edge of the skirt at a sharp corner to define a stress concentration point, the lower edge of the leading edge of each bridge intersecting the band along a radius, the upper edge of the trailing edge of each bridge intersecting the lower edge of the skirt along a radius, the lower edge of the trailing edge of each bridge intersecting the upper edge of the band along a radius, such that when the closure is rotated to unthread the closure from the container, the bridges break at the stress concentration points at the edge of the skirt of the closure.

2. The tamper indicating package set forth in claim 1 wherein each bridge extends generally centrally from the support.

3. The tamper indicating package set forth in claim 2 wherein each said support includes a recess facing the skirt, each bridge extending from the recess to the skirt.

4. The tamper indicating package set forth in claim 3 wherein one edge of said bridge forms an acute angle with the lower edge of the skirt and extends rearwardly with respect to the direction of rotation of the closure during unthreading, the other edge of said bridge extending vertically.

5. The tamper indicating package set forth in claim 1 wherein each bridge decreases in cross section from said band toward said skirt.

6. The tamper indicating package set forth in claim 1 whrein said portions on said band engaging the bead on the container comprise integral flexible flange means extending upwardly and inwardly from said skirt.

7. The tamper indicating package set forth in claim 6 wherein said integral flexible flange means comprises a continuous flange.

8. A tamper indicating closure for a container having a neck with an external thread and an annular retaining bead below the thread, said closure comprising a plastic body comprising a base wall, a peripheral skirt and a tamper indicating band connected to the free edge of the peripheral skirt by integral bridges, said tamper indicating band including portions that extend below the annular bead on the container such that when the closure is unthreaded, the bridges are broken, said band including circumferentially spaced supports that extend axially toward the free edge of the peripheral skirt, said bridges extending from the supports to the free edge and being inclined circumferentially in a direction opposite to that which the closure is rotated during unthreading from the container, the upper edge of the leading edge of each bridge intersecting the lower edge of the skirt at a sharp corner to define a stress concentration point, the lower edge of the leading edge of each bridge intersecting the band along a radius, the upper edge of the trailing edge of each bridge intersecting the lower edge of the skrit along a radius, the lower edge of the trailing edge of each bridge intersecting the upper edge of the band along a radius, such that when the closure is rotated to unthread the closure from the container, the bridges break at the stress concentration points at the edge of the skirt of the closure.

9. The tamper indicating closure set forth in claim 8 wherein each bridge extends generally centrally from the support.

10. The tamper indicating closure set forth in claim 9 wherein each said support includes a recess facing the skirt, each bridge extending from the recess to the skirt.

11. The tamper indicating closure set forth in claim 10 wherein one edge of said bridge forms an acute angle with the lower edge of the skirt and extends rearwardly with respect to the direction of rotation of the closure during unthreading, the other edge of said bridge extending vertically.

12. The tamper indicating closure set forth in claim 8 wherein each bridge decreases in cross section from said band toward said skirt.

13. The tamper indicating closure set forth in claim 8 wherein said portions on said band engaging the bead on the container comprise integral flexible flange means extending upwardly and inwardly from said skirt.

14. The tamper indicating closure set forth in claim 13 wherein said integral flexible flange means comprises a continuous flange.

15. A tamper indicating package including a container having a neck with an external thread, retaining bead below the thread, a plastic closure comprising a base wall, a peripheral skirt and a tamper indicating band connected to the free edge of the peripheral skirt by integral bridges, said tamper indicating band including portions that extend below the annular bead on the container such that when the closure is unthreaded, the bridges are broken, said bridges extending from the band to the skirt, each bridge having a first generally axial leading edge and second generally axial trailing edge, said first edge being inclined circumferentially in a direction opposite to that which the closure is rotated during unthreading from the container, the upper edge of the leading edge of each bridge intersecting the lower edge of the skirt at a sharp corner to define a stress concentration point, the lower edge of the leading edge of each bridge intersecting the band along a radius, the upper edge of the trailing edge of each bridge intersecting the lower edge of the skrit along a radius, the lower edge of the trailing edge of each bridge intersecting the upper edge of the band along a radius, such that when the closure is rotated to unthread the closure from the container, the bridges break at the stress concentration points at the edge of the skirt of the closure.

16. The tamper indicating package set forth in claim 15 wherein each bridge decreases in cross section from said band toward said skirt.

17. A tamper indicating closure for a container having a neck with an external thread and an annular retaining bead below the thread, said closure comprising a plastic body comprising a base wall, a peripheral skirt and a tamper indicating band connected to the free edge of the peripheral skirt by integral bridges, said tamper indicating band including portions that extend below the annular bead on the container such that when the closure is unthreaded, the bridges are broken, said bridges extending from the band to the skirt, each bridge having a first generally axial leading edge and second generally axial trailing edge, said first edge being inclined circumferentially in a direction opposite to that which the closure is rotated during unthreading from the container, the upper edge of the leading edge of each bridge intersecting the lower edge of the skirt at a sharp corner to define a stress concentration point, the lower edge of the leading edge of each bridge intersecting the band along a radius, the upper edge of the trailing edge of each bridge intersecting the lower edge of the skirt along a radius, the lower edge of the trailing edge of each bridge intersecting the upper edge of the band along a radius, such that when the closure is rotated to unthread the closure from the container, the bridges break at the stress concentration points at the edge of the skirt of the closure.

18. The tamper indicating closure set forth in claim 17 wherein one edge of said bridge forms an acute angle with the lower edge of the skirt and extends readwardly with respect to the direction of rotation of the closure during unthreading, the other edge of said bridge extending vertically.

* * * * *